United States Patent [19]

Blevins et al.

[11] Patent Number: 4,543,384

[45] Date of Patent: Sep. 24, 1985

[54] COOLING TOWER FILL COMPOSITIONS

[75] Inventors: Jack F. Blevins, Leola; Jay L. Piersol, Lancaster, both of Pa.

[73] Assignee: Armstrong World Industries, Inc., Lancaster, Pa.

[21] Appl. No.: 467,196

[22] Filed: Feb. 17, 1983

Related U.S. Application Data

[63] Continuation-in-part of Ser. No. 202,619, Oct. 31, 1980, abandoned.

[51] Int. Cl.[4] ..... C08L 15/02; D21H 5/18

[52] U.S. Cl. ..... 524/501; 162/155; 524/500; 524/522

[58] Field of Search ..... 524/501, 500, 522; 162/155

[56] References Cited

U.S. PATENT DOCUMENTS

| | | | |
|---|---|---|---|
| 2,868,641 | 1/1959 | Feigler, Jr. | 92/21 |
| 4,002,527 | 1/1977 | Piersol | 162/155 |
| 4,263,184 | 4/1981 | Leo et al. | 260/17.4 |

*Primary Examiner*—Paul Lieberman
*Assistant Examiner*—Robert A. Wax

[57] ABSTRACT

A composition is disclosed which is preferably produced by the beater saturation process in which water is removed from an aqueous furnish composition comprising asbestos fibers, an acrylic acid polymer and a synthetic rubber binder. The resulting composition can be formed into a fill for cooling towers which has improved capacity for a chlorinated rubber saturant.

12 Claims, No Drawings

COOLING TOWER FILL COMPOSITIONS

CROSS REFERENCE TO RELATED APPLICATION

This application is a continuation-in-part of U.S. application Ser. No. 202,619 filed Oct. 31, 1980, now abandoned in the name of Jack F. Blevins et al. and entitled "Cooling Tower Fill Compositions."

BACKGROUND OF THE INVENTION

Cooling towers are utilized to remove heat from process water through evaporation and heat transfer. Fill utilized in such cooling towers should possess high heat resistance and, equally important, minimal water saturation capacity.

It is well-known that asbestos fibers and synthetic rubber binders can be formed into felt sheet compositions that, when suitably shaped, can be utilized to make generally satisfactory cooling tower fill. Customarily, such sheets are impregnated with various materials to improve the sheets' rigidity, lifetime and wet strength, decrease the sheets' rate of water absorption and to provide sheet materials that lend themselves more readily to the formation of shaped cooling tower fill materials in corrugated and saddle forms. Suitable impregnating materials are resins such as melamine-formaldehyde resins and phenol resins and chlorinated rubber. The chlorinated rubber is particularly desirable to use for such purposes because, besides the advantageous properties set forth above, it also imparts an improved degree of fire resistance to the asbestos synthetic rubber binder sheets.

It has been discovered, however, that asbestos-rubber binder sheets which normally take up water based resins such as melamine formaldehyde resins and phenol resins do not as readily take up the chlorinated natural rubber. Therefore, it would be desirable to improve the saturation capacity of the sheets for the chlorinated natural rubber.

It is an object, therefore, of the present invention to improve the saturation capacity of standard asbestos fiber-rubber binder cooling tower fill compositions for chlorinated natural rubber.

This, and other objects as expressed herein, is surprisingly accomplished by incorporating a small amount of a specified acrylic acid polymer in an asbestos fiber-synthetic rubber binder composition to thereby produce a composition that has improved saturation capacity for chlorinated natural rubber and which thereby can be formed into cooling tower fill with improved properties.

SUMMARY OF THE INVENTION

The invention contemplates a composition, typically in the form of a felt sheet, that can be formed into fill for cooling towers. The composition is comprised of asbestos fibers, a synthetic rubber binder, and an acrylic acid polymer. In weight parts per 100 parts of the total fiber weight the composition contains from about 0.25 to about 2 parts and preferably from about 0.5 to about 0.75 parts of an acrylic acid polymer. Employing less than 0.25 weight parts of acrylic acid polymer does not significantly improve the capacity of the resulting sheet composition, when compared with a standard asbestos-rubber binder sheet composition, to absorb the chlorinated natural rubber. Amounts greater than 2.0 weight parts can produce a sheet that is so stiff and boardlike that it may not be readily formed into cooling tower fill.

The use of the aforementioned acrylic acid polymer in the composition results in a product that has improved saturation capacity for chlorinated natural rubber. Furthermore, when the felt sheet is formed by the preferred method, that is by what is commonly referred to as the "beater saturation process," the use of the acrylic acid polymer results in shorter drain times and improved wet strength of the beater saturation slurries when compared to the drain times and wet strength of standard rubber binder-asbestos fiber slurries.

DETAILED DESCRIPTION OF THE INVENTION

Asbestos fibers are the fibers of choice in the sheet composition, because their fire resistant and non-biodegradable properties are particularly worthwhile for cooling tower fill compositions.

Any synthetic rubber binder which is used in standard beater saturation processes may be employed in the composition of the present invention. In a preferred embodiment of the present invention the fibers are bound together by a synthetic rubber which is deposited on the fibers by precipitation from a latex of the synthetic rubber. Any suitable synthetic anionic-type rubber latex can be employed—including vinylidene chloride latex, nitrile rubber, styrene butadiene latexes, carboxylated styrene butadiene latexes, carboxylated acryonitrile butadiene, polychloroprenes (neoprene), and the like. These latexes can be used singularly or in combination. The preferred synthetic rubber binders will be halogenated for improved fire resistance. A particularly suitable rubber latex is Dow Chemical Company's 30175.00 vinylidene chloride latex (which contains 47–49% solids and has a pH of from 7.2–8.2, surface tension of 45–60 dynes/cm, weight per U.S. gallon of 9.16–9.2 lbs. and 34% chlorine content), or a 50—50 weight part mixture of Dow's vinylidene chloride latex and neoprene.

The acrylic acid polymers suitable for use herein have repeating units of the formula

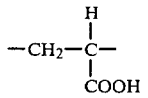

and have a molecular weight of from about 200,000 to about 3,000,000, said molecular weights being obtained by the light scattering technique. Acrylic acid polymers having molecular weights below the lower limit specified above are not effective in that they do not sufficiently promote the capacity of the sheet to absorb chlorinated natural rubber. Acrylic acid polymers having molecular weights above the upper limit specified above are difficult in the aqueous furnish composition and, in addition, are generally more expensive. The most preferred acrylic acid polymers have a molecular weight of from 250,000 to 600,000. Such polymers are available commercially from the BF Goodrich Company and are designated by the tradename Carbopol ® Resins.

The aqueous furnish composition can also include a latex antioxidant, biocides, coloring agents, latex dispersing agents and the like.

The aqueous furnish composition will preferably contain about 2 to about 4 parts by weight of a latex antioxidant per 100 parts of the synthetic rubber binder weight. Any conventionally employed latex antioxidants that are suitable for use with synthetic rubber binders may be used herein. A particularly suitable latex antioxidant is designated "Flectol H," commercially available from Monsanto Industrial Chemicals Company. Flectol H is polymerized 2,2,4-trimethyl-1,2-dihydro quinoline. Other suitable antioxidants include, for example, B. F. Goodrich Chemical Company's "Agerite White" antioxidant, which is sym-Di-beta-naphthyl-para-phenylenediamine.

The amount of synthetic rubber binder utilized must be sufficient to bind the asbestos fibers. Generally about 8 weight parts of binder per 100 weight parts of asbestos fibers are sufficient for such purposes. As a maximum figure, generally no more than about 20 weight parts of binder should be employed per 100 weight parts of asbestos—amounts greater than that will have a deleterious effect on the ability of the sheet composition to absorb chlorinated natural rubber. Most preferably, from about 9 to about 15 weight parts of binder per 100 weight parts of fiber are employed herein.

The felt sheet composition can be made by any of the well-known processes for forming such sheets from fibers and binders. To produce the sheet in accordance with a preferred embodiment of this invention the asbestos fibers the acrylic acid polymer and any additives are slurried in water to the usual consistency of beater saturation processes, normally in the range of 0.5%-3% by weight fibers in the slurry. The fibers must be coated with the acrylic acid polymer before the deposition of the synthetic rubber binder on the fibers. If the latex is added to the fibrous aqueous furnish before the addition of the acrylic acid polymer, the fibers will be flocked into bundles and, while the acrylic acid polymer will coat the outside of the bundles, the individual fibers within the bundles will not be coated, reducing the saturability of the resulting sheet to chlorinated rubber.

The asbestos fibers will normally be subjected to being pretreated by beating or other mechanical refining treatment in accordance with normal processes in order that the fiber drain time will be in the range of about 100–180 seconds. Although beating will normally be the way the fibers are pretreated, other refining apparatus may be used such as disc refiners, Jordan engines, and the like. The above-mentioned fiber drain time is measured by immersing 40 g of fiber in 13 liters of water and thereafter measuring the drain time on a 12"×12" sheet mold.

After forming the aqueous slurry in the desired consistency and after any mechanical refining, synthetic rubber latex is then added to the mixture until the latex precipitates onto the fibers. Water is removed from the resulting furnish composition to form the felt sheet.

To form the sheet into material suitable for use as cooling tower fill, the felt sheet is immersed in or otherwise treated with a solution comprising powdered chlorinated natural rubber dissolved in a suitable solvent. The sheet may be conveniently treated with the above-mentioned solution by passing the dried sheet on rollers into or through a bath of the solution, followed by removal of the solution-soaked sheet from the bath. As the sheet emerges from the bath, it may pass between rollers to press excess solution from the sheet.

The sheet must be in contact with the solution sufficiently long for a chlorinated natural rubber pickup of from about 15 to about 30%, based on the pre-immersion weight of the sheet. The contact time of the sheet and the solution will depend to some extent on the thickness of the sheet, on the exact solvent used in the solution, and the amount of chlorinated natural rubber utilized. For instance, when a 5:13 weight ratio of chlorinated natural rubber to toluene solvent is employed, it has been found that, for sheets having 0.017 to about 0.021 in., a contact time of 45 to 75 seconds will suffice to result in the desired chlorinated natural rubber pickup, which is determined by standard chlorine analysis. Room temperature conditions will normally be used in the contact step, although slightly elevated temperatures may reduce the contact time if such is desired.

After passing through any squeeze rolls on emergence from the bath, the sheet is shaped into a series of corrugations and, while being held in place, is dried to remove excess solvent. This may be carried out in any convenient manner, due care being given to any flammability and inhalation hazards of the volatile solvent. Elevated temperatures will normally be used in solvent removal. A convenient way to remove the solvent will be in a forced hot air oven.

The resulting corrugated sheet will be stiff and board-like.

The products made by the process of the present invention are advantageous in their adaptability to be formed into various shapes, their fire resistance, their resistance to deterioration under the constant flow of water and the impingement of high velocity air, and their ability to retain their shape.

The powdered chlorinated natural rubber utilized in the above step is available in powdered form in a variety of viscosities as determined in a 20% concentration in toluene. The specific volume of the material will generally average around 70 cubic inches per pound. It is soluble in toluene, xylene, aromatic hydrocarbon, esters, ketones, and some other commercially available solvents.

Suitable chlorinated natural rubber will contain from about 50% to about 75% chlorine by weight. The amount of chlorinated natural rubber dissolved in the solvent will be generally in the range of about 20 to about 35 weight parts per 100 weight parts solvent.

Particularly suitable chlorinated natural rubbers are available from Hercules Inc. under the trade designation Parlon. A particularly suitable chlorinated natural rubber is Parlon S-10, which contains 67% chlorine by weight.

The solvent for the chlorinated natural rubber specified above should not be capable of dissolving the synthetic rubber binder utilized in the composition of the present invention. For instance, when vinylidene chloride latex is the binder, the solvent of choice is toluene. When neoprene and the NBR rubbers are used, solvents such as benzene, chlorinated aromatic solvents, chlorinated aliphatic solvents, and other aliphatic and aromatic solvents may be used provided as stated above, they do not dissolve the binder.

The following examples demonstrate the preparation of the composition of this invention. Carbopol 801 is a trade designation for an acrylic acid polymer having a molecular weight of about 250,000.

EXAMPLE I

| Ingredients | Amount (Parts by Weight) |
|---|---|
| asbestos fibers | 28.8 g (100) |
| Carbopol 801 | 0.144 g (0.5) |
| carbon black coloring agent | 0.425 g (1.5) |
| antioxidant (Flectol H) | 0.103 g (0.36) |
| vinylidene chloride latex (Dow 30175.00) | 3.17 g (11) |

To a mixing vessel containing about 1500 ml of water were added the total amounts of the refined asbestos fibers, the Carbopol, the coloring agent and the antioxidant. The contents of the mixing vessel were slurried for about 2 minutes to assure full dispersion of the ingredients at 1.9% consistency. The total amount of synthetic rubber latex was added with stirring for about 2 minutes until the latex precipitated, that is, the latex deposited on the fibers thus serving as a drainage aid and a binder in the resulting composition.

The resulting slurry was formed into a hand sheet using a conventional Williams hand sheet mold. The resulting hand sheet was then wet pressed to remove excess moisture and drum dried at a temperature of about 230° F.

The resulting dried handsheet, which was 0.019 in. thick, was immersed for 1 minute in a solution of 75 ml toluene in which was dissolved 25 g of Parlon S-10 chlorinated natural rubber. On removal from the solution, the sheet was placed in a forced air circulating oven for several minutes until dry.

The resulting dried sheet was stiff, boardlike, and suitable for use as cooling tower fill. The sheet met federal specifications for fire resistance in cooling tower fill.

The sheet was weighed both before the above-described immersing step and after it was immersed and dried to determine the amount of chlorinated natural rubber the sheet picked up expressed as a percentage of the sheet's pre-immersion weight. For its primary use as a cooling tower fill, it is desirable that the sheet pickup at least 15% chlorinated natural rubber. The test results are set forth in the TABLE.

COMPARATIVE EXAMPLE I

In a comparative example, the procedure of Example I was repeated exactly, except that an acrylic acid polymer was not utilized in the formation of the sheet. As in Example I, the dried handsheet was immersed in a chlorinated natural rubber/toluene solution and then dried. The product of this comparative Example was subjected to the same weighing tests as was the product of Example I. The test results are set forth in the TABLE across from the heading "Control."

EXAMPLES 2-5

In these Examples the procedures of Example 1 were repeated exactly, except that the amount of acrylic acid polymer (Carbopol 801) utilized in the production of the sheet composition varied in each Example. The products of these Examples were subjected to the same weighing tests as was the product of Example I to determine how much chlorinated natural rubber was picked up by the sheets. The test results are set forth in the TABLE.

TABLE

| Example | Amount Acrylic Acid Polymer Utilized (As Parts by Weight Per 100 Parts Asbestos Fibers) | Percent Pickup of Chlorinated Natural Rubber |
|---|---|---|
| 1 | 0.5 | 22.1 |
| 2 | 2 | 23.3 |
| 3 | 1.5 | 21.4 |
| 4 | 1.0 | 21.2 |
| 5 | 0.25 | 16.8 |
| Control | 0 | 11.9 |

What is claimed is:

1. A felt sheet composition comprising asbestos fibers, a synthetic rubber binder and an acrylic acid polymer having repeating units of the formula

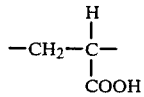

said polymer having a molecular weight, which is determined by the light scattering technique, of from about 200,000 to about 3,000,000 wherein there are, in weight parts per 100 parts of fiber weight, from about 0.25 to about 2 weight parts acrylic acid polymer in said composition.

2. The composition of claim 1 wherein there are, in weight parts per 100 parts of fiber weight, from about 9 to about 15 weight parts synthetic rubber binder.

3. The composition of claim 1 further comprising from about 2 to about 4 weight parts of a latex antioxidant per 100 weight parts of the synthetic rubber binder.

4. The composition of claim 1 wherein the polymer has a molecular weight of from about 250,000 to about 600,000.

5. The composition of claim 1 wherein the synthetic rubber binder is vinylidene chloride latex.

6. The composition of claim 1 wherein the synthetic rubber binder is a mixture of vinylidene chloride latex and neoprene.

7. A beater saturated, water-laid, rubberized composition produced by removing water from an aqueous furnish composition comprising asbestos fibers; a synthetic rubber binder; and an acrylic acid polymer consisting essentially of repeating units of the formula

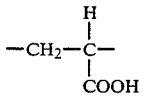

said polymer having a molecular weight of from about 200,000 to about 3,000,000, said molecular weight being determined by the light scattering technique.

8. The composition of claim 7 further comprising a latex antioxidant.

9. The composition of claim 8 in which said latex antioxidant is employed in the amount within the range of from about 2 to about 4 parts by weight per 100 parts of the synthetic rubber binder.

10. The composition of claim 7 in which said acrylic acid polymer is employed in an amount within the range of from about 0.25 to about 2 parts by weight per 100 parts of fiber weight and said synthetic rubber binder is employed in an amount within the range of from about 9 to about 15 parts by weight per 100 parts of fiber weight.

11. The composition of claim 7 further comprising from about 15 weight percent to about 30 weight percent add on of a chlorinated natural rubber.

12. A method of producing a felt sheet composition, which method comprises (a) forming an aqueous slurry containing asbestos fibers and an acrylic acid polymer, said polymer consisting essentially of repeating units of the formula

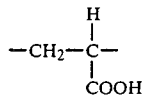

said polymer having a molecular weight of from about 200,000 to about 3,000,000;

(b) adding a synthetic rubber latex to the slurry to thereby precipitate the latex on the fibers and form a furnish composition; and (c) removing water from the composition to thereby form the felt sheet composition.

* * * * *